United States Patent [19]

Steffen

[11] 4,037,527

[45] July 26, 1977

[54] GRAIN DRYING APPARATUS

[76] Inventor: Vincent B. Steffen, 321 E. Hamilton, New Hampton, Iowa 50659

[21] Appl. No.: 622,638

[22] Filed: Oct. 15, 1975

[51] Int. Cl.[2] ..... E04H 7/22

[52] U.S. Cl. ..... 98/55; 34/233; 285/158; 285/405

[58] Field of Search ..... 98/52–55, 98/6; 62/418; 34/225, 233; 285/158, 405, 412

[56] References Cited

U.S. PATENT DOCUMENTS

| | | | |
|---|---|---|---|
| 1,488,057 | 3/1924 | Pilz | 34/233 X |
| 1,643,892 | 9/1927 | Hull | 98/6 X |
| 1,712,832 | 5/1929 | Lichtenberg | 285/158 X |
| 2,065,251 | 12/1936 | Sweeley et al. | 98/6 X |
| 2,070,044 | 2/1937 | Gilpin | 98/6 X |
| 3,368,756 | 2/1968 | Edwards | 98/37 X |
| 3,426,445 | 2/1969 | Steffen | 98/55 X |
| 3,531,874 | 10/1970 | Sukup | 98/55 X |
| 3,877,241 | 4/1975 | Wade | 62/137 |

*Primary Examiner*—William E. Wayner
*Assistant Examiner*—William E. Tapolcai, Jr.
*Attorney, Agent, or Firm*—Henderson, Strom and Sturm

[57] ABSTRACT

Grain drying apparatus of a type having a grain bin having a grain receiving chamber, a plenum chamber for receiving air from an air circulating mechanism, and a perforated floor separating the plenum chamber from the grain receiving chamber. An opening in the side wall of the grain bin is located partially above and partially below the perforated floor in order to eliminate the cold spot due to a lack of air flow normally found above grain drying fans. An annular flanged connection device is provided for facilitating easy connection and disconnection of the air circulating mechanism to and from the grain bin.

5 Claims, 3 Drawing Figures

GRAIN DRYING APPARATUS

BACKGROUND OF THE INVENTION

The present invention relates generally to a grain drying apparatus and more particularly to a grain drying apparatus for use in conjunction with a storage type of grain bin having a perforated floor therein.

One of the most popular types of grain drying systems includes a grain bin which has a grain receiving chamber on the top portion thereof, a plenum chamber on the bottom portion thereof and a perforated floor dividing the plenum chamber from the grain receiving chamber. A fan of some sort is then normally mounted to the grain bin in direct communication with the plenum chamber. Such a fan is normally connected first to a concrete slab which has been poured or placed adjacent the grain bin and then directly to an opening in the bin.

It has been found that the grain in the grain receiving chamber which lies directly above the fan does not receive adequate air flow therethrough. This is caused primarily because the force of the air from the fan distributes the air directly past the grain thereabove and the force of this air from the fan creates a higher pressure immediately around the fan outlet which substantially prevents the air which is flowing in the plenum chamber and up through the floor from flowing directly upward above the fan outlet.

There is a substantial expense involved in providing the concrete foundation which is usually used to support a grain drying fan as discussed above. Heretofore, however, there has not been an adequate substitute found for such a support mounting.

Another problem associated with the mounting of a grain drying fan to a grain drying bin, has been the one of being able to disconnect and reconnect the grain drying fan from and to the bin in an efficient manner. This is true primarily because the fans have in the past been bolted directly to the grain bin and a portion of the nut and bolt assemblies used in such installations are necessarily inside of the plenum chamber. This creates no problem when the bin is being constructed, but when the bin is in use it is extremely difficult and sometimes impossible to have the access to the plenum chamber for adequately tightening or loosening the nut and bolt assemblies involved.

SUMMARY OF THE INVENTION

The present invention relates generally to a grain drying bin having a perforated floor therein which divides a plenum chamber for receiving air from an air circulating means from a grain receiving chamber for receiving and drying grain. An opening in the sidewall in the bin lies partially above and partially below the perforated floor for providing adequate ventilation to the grain which lies in the grain receiving chamber immediately above the fan or air circulating means. A fan mounting structure is also provided for facilitating easy conection and disconnection of the air circulating means of the grain bin without requiring access to the interior of the plenum chamber.

An object of the present invention is to provide adequate air flow for all sections of a grain drying bin.

Another object of the invention is to prevent the grain which lies directly above the grain drying fan in a grain drying bin from receiving too little air flow.

A further object of the invention is to eliminate the need for the conventional concrete foundation which is normally used to mount a grain drying fan to a grain drying bin.

Still another object of the present invention is to provide a structure for facilitating quick and simple connection and disconnection of a grain drying fan to a grain drying bin.

Other objects, advantages, and novel features of the present invention will become apparent from the following detailed description of the invention when considered in conjunction with the accompanying drawings.

DESCRIPTION OF THE PREFERRED EMBODIMENT

Figure 1:
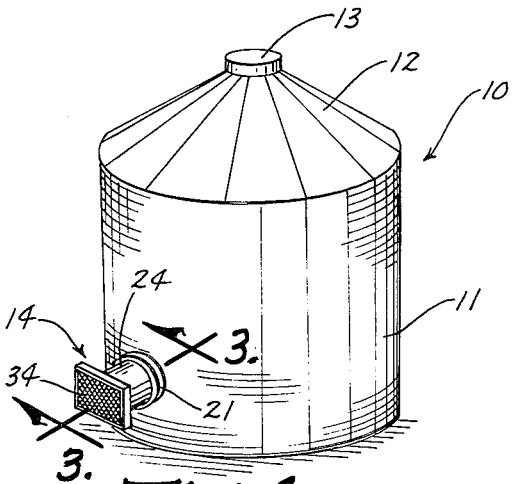
FIG. 1 is a perspective view of a grain bin in association with the grain apparatus of the present invention.

Referring now to the drawings wherein like reference numerals designate identical or corresponding parts throughout the several views, FIG. 1 shows a grain bin 10 having side walls 11 and a roof 12. An opening 13 is disposed in the top of the roof 12 and this opening 13 can be closed by a door (not shown) if desired. An air circulating device 14 is shown generally in FIG. 1.

Figure 2:
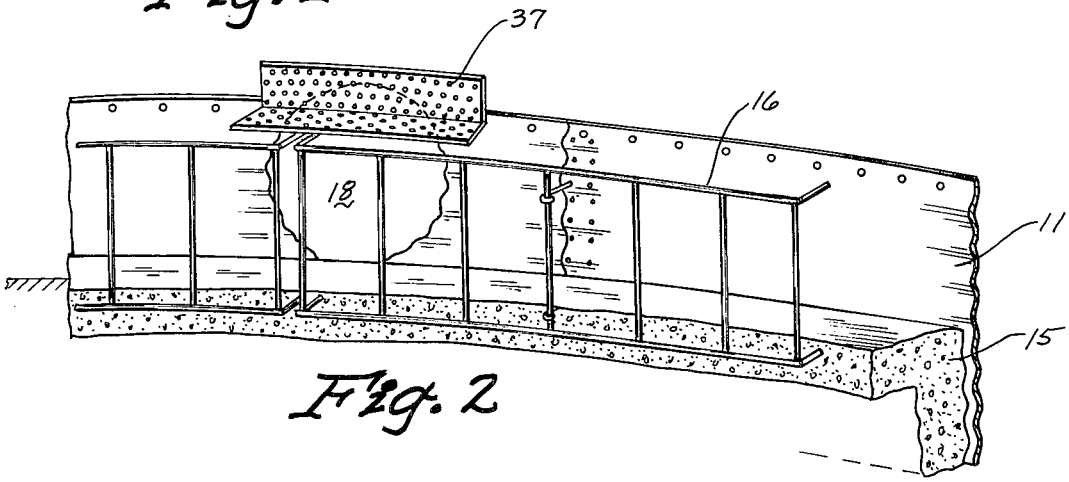
FIG. 2 is a partial, enlarged, perspective view of one aspect of the present invention viewed from the interior of the grain bin.

FIG. 2 shows a concrete foundation 15 which is on the inside of the grain bin 10. The bottom of the sidewalls 11 surround the concrete foundation 15. The rod structure 16 is shown in FIG. 2 and it is this rod structure 16 which supports the perforated floor 17 shown in FIG. 3. The rod structure 16 is embedded in the concrete foundation 15 and is also secured to the sidewalls 11 (FIG. 2).

Figure 3:
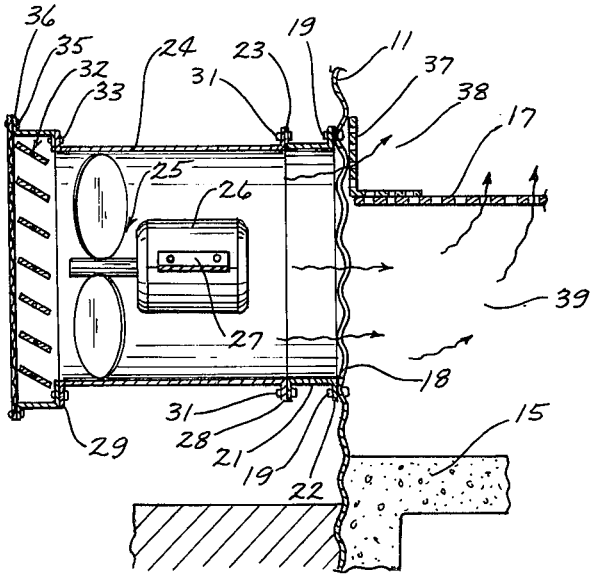
FIG. 3 is a cross sectional view taken along the lines 3—3 of FIG. 1.

FIG. 3 shows a circular opening 18 which has been cut into the sidewalls 11 of the bin 10. A series of holes have been bored around the perimeter 18 so as to receive bolt and nut structures 19. These bolt and nut structures 19 serve to secure the cylindrically or annular shaped connecting means 21 to the sidewalls 11. The mounting structure 21 has a pair of flanges 22 and 23 secured to the ends thereof, and it is these flanges which allow for the ease with which a fan or other structure needed to be connected to a grain bin opening can be connected or disconnected. While the cylindrical mounting structure 21 has been shown to be generally circular in cross section, it will be clear to those skilled in this art that other shapes are fully equivalent thereto, such as a square, rectangular, oval or other shape.

A fan housing 24 can best be seen in FIG. 3. The fan housing 24 has a fan 25 connected on the interior thereof which is powered by an electric motor 26. The electric motor 26 and thereby the fan 25 is mounted to the fan housing 24 by a pair of brackets 27, only one of which is illustrated. The fan housing 24 has radially extending flanges 28 and 29 on the extreme ends thereof which serve to connect it on one end thereof to the mounting housing 21 by nut and bolt structures 31 and to the adjustable baffle structure 32 on the other end thereof by nut and bolt structures 33. A screen 34 is mounted to the baffle structures 32 by the use of nut and bolt structures 35 and flanges 36.

A very important aspect of this invention is the placement of the perforated plate 37 which has been bent into a right angle configuration. This plate 37 is bolted to the floor 17 and allows for the circulation of air up through the floor and also through the opening 18. The perforated plate 37 prevents grain such as corn from passing from the grain receiving chamber 38, which is located on the right side of the plate 37 as seen in FIG. 3, to the interior of fan housing 24. The perforated plate 37 does, however, allow the air to flow directly into the grain receiving chamber 38 such that this grain directly adjacent the upper portion of the fan 25 would receive the air flow needed in order to remove the desired moisture from this corn and prevent it from spoiling. Previously, all drying fans have been located below the perforated floor 17 so that the flow of air from the fan 25 would be blown only into the plenum chamber 39 and never directly into the grain receiving chamber 38.

Referring again to the mounting housing 21, it can be easily seen that the nut and bolt structures 19 can be used to originally mount the mounting structure 21 on the bin and that there is no further need to have access to the interior of the bin in order to loosen or tighten the nut and bolt structures 19. Instead, the nut and bolt structures 31 are positioned so that there is easy access to them from the outside of the bin. This clearly facilitates easy removal of the housing 24 and thereby easy access to the fan and motor 25 and 26 for repairs if needed.

Accordingly, it is believed to be clear that all of the objects referred to above are indeed accomplished by the illustrated preferred embodiment. Obviously many modifications and variations of the present invention are possible in light of the above teachings. It is therefore to be understood that, within the scope of the appended claims, the invention may be practiced otherwise than specifically described.

I claim:

1. In a grain bin having sidewalls forming a chamber for receiving grain, a plenum chamber for receiving air from an air circulating means and a perforated floor dividing the plenum chamber from the grain receiving chamber for allowing air to flow from the plenum chamber to the grain receiving chamber, the improvement comprising:

an opening in a sidewall of said bin, part of said opening lying above said perforated floor and part of said opening lying below said perforated floor;

a perforated plate disposed between said opening and said grain receiving chamber for preventing grain from flowing out of said opening but allowing the flow of air from said opening directly into said grain receiving chamber; and means for connecting said air circulating means to said opening for causing air to enter said plenum chamber and said grain receiving chamber through said opening.

2. Apparatus as defined in claim 1 wherein said connecting means comprises:

a cylindrical housing;

radially outwardly extending flanges connected to each end of said cylindrical housing;

means for attaching one of said flanges to a bin sidewall; and means for attaching the other of said flanges to a second cylindrical housing.

3. Apparatus as defined in claim 2 wherein said means for attaching one of said flanges to a wall comprises a plurality of holes in said one for receiving bolts.

4. Apparatus as defined in claim 3 wherein said means for attaching the other of said flanges to one end of a second cylindrical housing comprises a plurality of holes disposed in said other flange.

5. Apparatus as defined in claim 4 wherein said air circulating means comprises an electric fan mounted within said second cylindrical housing.

* * * * *